US009077077B2

(12) United States Patent
Wong et al.

(10) Patent No.: US 9,077,077 B2
(45) Date of Patent: Jul. 7, 2015

(54) MOBILE COMMUNICATION DEVICE AND ANTENNA DEVICE

(75) Inventors: Kin-Lu Wong, Kaohsiung (TW); Ting-Wei Kang, Kaohsiung (TW); Shih-Wei Hsieh, Taipei (TW); Wei Yu Chen, New Taipei (TW)

(73) Assignees: MEDIATEK SINGAPORE PTE. LTD., Singapore (SG); NATIONAL SUN YAT-SEN UNIVERSITY, Kaohsiung (TW)

( * ) Notice: Subject to any disclaimer, the term of this patent is extended or adjusted under 35 U.S.C. 154(b) by 235 days.

(21) Appl. No.: 13/182,277

(22) Filed: Jul. 13, 2011

(65) Prior Publication Data

US 2013/0016013 A1 Jan. 17, 2013

(51) Int. Cl.

| | |
|---|---|
| ***H01Q 1/38*** | (2006.01) |
| ***H01Q 1/24*** | (2006.01) |
| ***H01Q 9/04*** | (2006.01) |
| ***H01Q 19/00*** | (2006.01) |

(52) U.S. Cl.

CPC ..... *H01Q 1/38* (2013.01); *H01Q 1/243* (2013.01); *H01Q 9/04* (2013.01); *H01Q 19/005* (2013.01)

(58) Field of Classification Search

USPC ..... 343/700 MS, 702

See application file for complete search history.

(56) References Cited

U.S. PATENT DOCUMENTS

| | | | | |
|---|---|---|---|---|
| 6,466,170 | B2 | 10/2002 | Zhou | |
| 6,552,686 | B2 | 4/2003 | Ollikainen et al. | |
| 6,842,141 | B2 * | 1/2005 | Suh et al. | 343/700 MS |
| 6,867,736 | B2 * | 3/2005 | Faraone et al. | 343/700 MS |
| 7,136,020 | B2 * | 11/2006 | Yamaki | 343/702 |
| 7,209,087 | B2 | 4/2007 | Tang et al. | |
| 7,656,353 | B2 | 2/2010 | Qi et al. | |
| 7,659,853 | B2 | 2/2010 | Chen et al. | |
| 7,688,267 | B2 | 3/2010 | Hill | |

(Continued)

FOREIGN PATENT DOCUMENTS

| | | |
|---|---|---|
| CN | 101154761 | 4/2008 |
| EP | 0 790 663 | 8/1997 |

(Continued)

OTHER PUBLICATIONS

Chi-Yuk Chiu, Chi-Ho Cheng, Ross D. Murch, and Corbett R. Rowell, Reduction of Mutual Coupling Between Closely-Packed Antenna Elements, Jun. 2007, IEEE Transaction on Antennas and Propagation, vol. 55, No. 6, pp. 1732-1738.*

*Primary Examiner* — Hoang V Nguyen
*Assistant Examiner* — Hai Tran
(74) *Attorney, Agent, or Firm* — McClure, Qualey & Rodack, LLP

(57) ABSTRACT

A mobile communication device for operating in LTE and WWAN bands is provided in the invention. The mobile communication device includes a system circuit board and an antenna. The system circuit board includes a system ground plane. The antenna includes: an antenna substrate, substantially parallel to the system ground plane; a first radiation element, disposed on the antenna substrate; a second radiation element, disposed on the antenna substrate; an antenna ground plane, disposed on the antenna substrate, and coupled to the system ground plane; and a transmission line, disposed on the antenna substrate, coupled to the first and second radiation elements, and having a feed point. The mobile communication device is further configured to accommodate a data transmission component.

27 Claims, 15 Drawing Sheets

(56) References Cited

U.S. PATENT DOCUMENTS

| | | | | |
|---|---|---|---|---|
| 2001/0052645 | A1* | 12/2001 | Op'T Eynde et al. | 257/700 |
| 2007/0035452 | A1* | 2/2007 | Lin et al. | 343/702 |
| 2007/0159398 | A1 | 7/2007 | Tsai et al. | |
| 2008/0074335 | A1 | 3/2008 | Suh | |
| 2008/0180326 | A1* | 7/2008 | Chen | 343/700 MS |
| 2008/0180333 | A1* | 7/2008 | Martiskainen et al. | 343/722 |
| 2010/0283685 | A1 | 11/2010 | Tsai et al. | |
| 2011/0084883 | A1* | 4/2011 | Wong et al. | 343/702 |
| 2011/0095949 | A1* | 4/2011 | Wong et al. | 343/702 |

FOREIGN PATENT DOCUMENTS

| | | |
|---|---|---|
| EP | 1 608 035 | 12/2005 |
| EP | 2 182 583 | 5/2010 |

* cited by examiner

401

402

MOBILE COMMUNICATION DEVICE AND ANTENNA DEVICE

BACKGROUND OF THE INVENTION

1. Field of the Invention

The disclosure generally relates to a mobile communication device, and more particularly, relates to a mobile communication device operating in LTE (Long Term Evolution) and WWAN (Wireless Wide Area Network, WWAN) frequency bands.

2. Description of the Related Art

Nowadays, 2G or 3G communication system technology is applied in notebooks, tablet PCs or mobile phones. Telecommunication manufacturers all over the world have actively introduced 4G LTE (Long Term Evolution) systems. Therefore, it is required that in small spaces, an antenna can operate in LTE and WWAN (Wireless Wide Area Network, WWAN) frequency bands.

The mobile communication device is also required to have Bio-Compatibility; that is, lower SAR (Specific Absorption Rate, SAR) and HAC (Hearing-Aid Compatibility, HAC). One of the solutions is to dispose an antenna on the bottom of the mobile communication device. However, there is usually a data transmission interface for transmitting or receiving data on the bottom of the mobile communication device. The data transmission interface significantly impacts the performance of the antenna.

BRIEF SUMMARY OF THE INVENTION

In one exemplary embodiment, the disclosure is directed to a mobile communication device, comprising: a system circuit board, comprising a system ground plane; and an antenna, comprising: an antenna substrate, substantially parallel to the system ground plane; a first radiation element, disposed on the antenna substrate; a second radiation element, disposed on the antenna substrate; an antenna ground plane, disposed on the antenna substrate, and coupled to the system ground plane; and a transmission line, disposed on the antenna substrate, coupled to the first and second radiation elements, and having a feed point.

In another exemplary embodiment, the disclosure is directed to an antenna device, comprising: a system ground plane; an antenna substrate, substantially parallel to the system ground plane; a first radiation element, disposed on the antenna substrate, and coupled to the system ground plane; a second radiation element, disposed on the antenna substrate, and coupled to the system ground plane; and a transmission line, disposed on the antenna substrate, and comprising: a first branch, close to the first radiation element, comprising a chip inductor, and coupled to a feed point; and a second branch, coupled to the feed point.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1A:
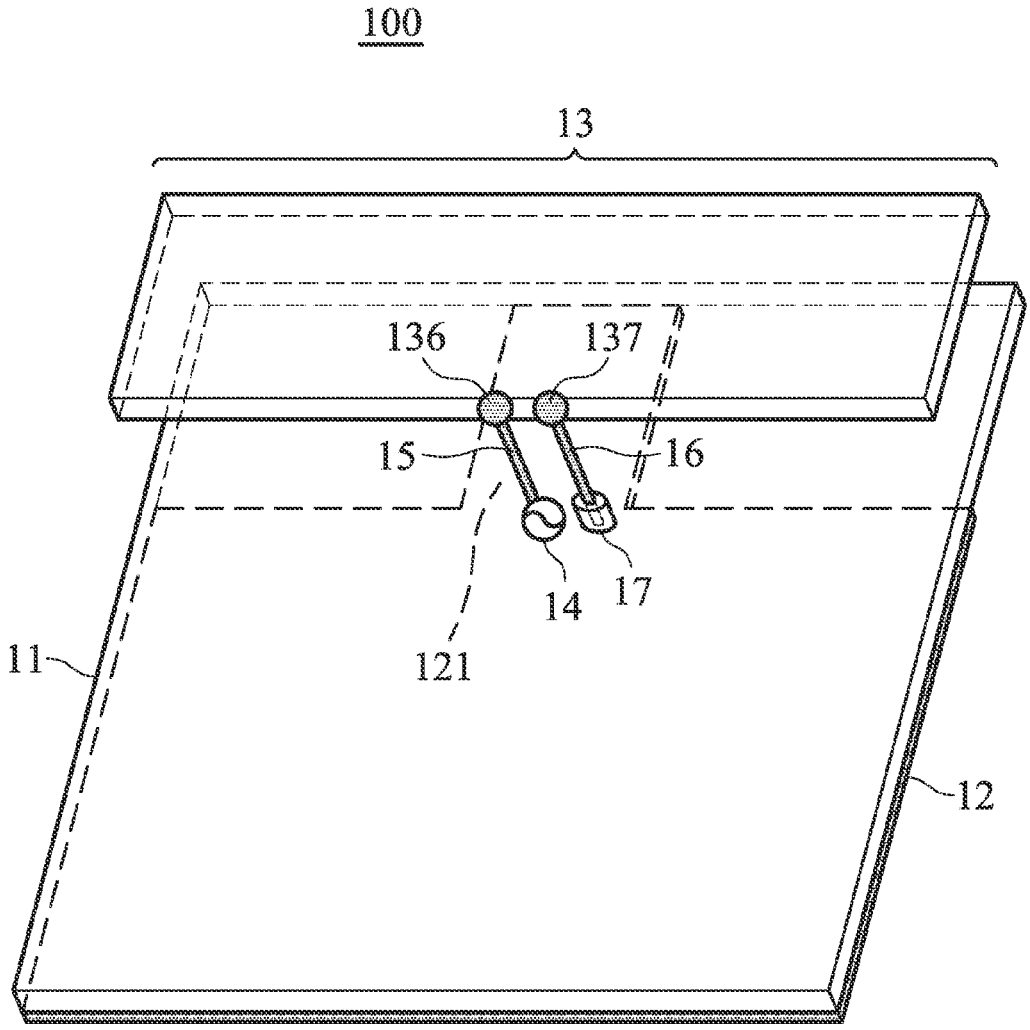
FIG. 1A is a pictorial drawing illustrating a mobile communication device according to an embodiment of the invention.

FIG. 1A is a pictorial drawing illustrating a mobile communication device 100 according to an embodiment of the invention. As shown in FIG. 1A, the mobile communication device 100 comprises a system circuit board 11 and an antenna 13. The system circuit board 11 comprises a system ground plane 12, which further comprises an additional ground 121 on the edge of the system ground plane 12.

Figure 1B:
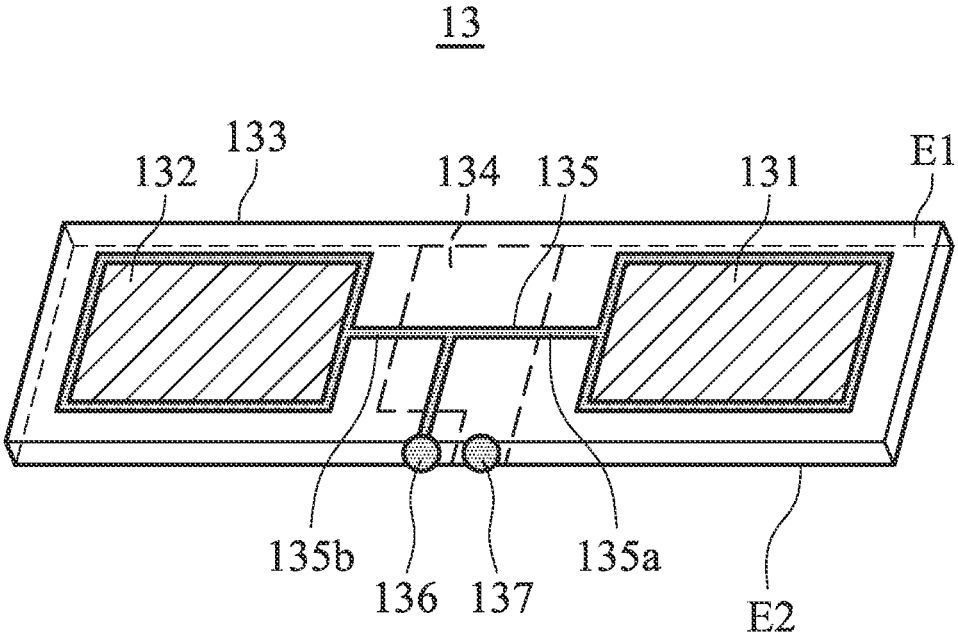
FIG. 1B is a pictorial drawing illustrating an antenna according to an embodiment of the invention.

FIG. 1B is a pictorial drawing illustrating the antenna 13 according to an embodiment of the invention. As shown in FIG. 1B, the antenna 13 comprises: a first radiation element 131, a second radiation element 132, an antenna substrate 133, an antenna ground plane 134, and a transmission line 135. The antenna substrate 133 is substantially parallel to the system ground plane 12. The first and second radiation elements 131, 132 are disposed on the antenna substrate 133. The antenna ground plane 134 is disposed on the antenna substrate 133 and electrically connected to the system ground plane 12 via a shorting point 137, which may be substantially disposed between the first and second radiation elements 131, 132. In some embodiments, the antenna ground plane 134 may substantially separate the first radiation element 131 from the second radiation element 132. The transmission line 135 is disposed on the antenna substrate 133 and electrically connected to the first and second radiation elements 131, 132 via first and second branches 135*a*, 135*b* of the transmission line 135, respectively. The transmission line 135 may have a feed point 136 for receiving signals, wherein the first and second branches 135*a*, 135*b* are both electrically connected to the feed point 136. In some embodiments, the transmission line 135 may be a microstrip line. In detail, the first and second radiation elements 131, 132 and the transmission line 135 may be disposed on a first surface E1 of the antenna substrate 133, and the antenna ground plane 134 may be disposed on a second surface E2, opposite to the first surface E1, of the antenna substrate 133. However, in another embodiment, the first and second radiation elements 132, 132, the transmission line 135 and the antenna ground plane 134 may be all disposed on the same surface, such as the first or second surfaces E1, E2. The system ground plane 12, the antenna ground plane 134 and the transmission line 135 may be made of metal, such as copper or silver.

Referring to FIG. 1A, the feed point 136 is electrically connected to a signal source 14 on the system circuit board 11 via a metal line 15. Similarly, the shorting point 137 is electrically connected to the system ground plane 12 via a metal line 16, through a via-hole 17 of the system circuit board 11.

Figure 1C:
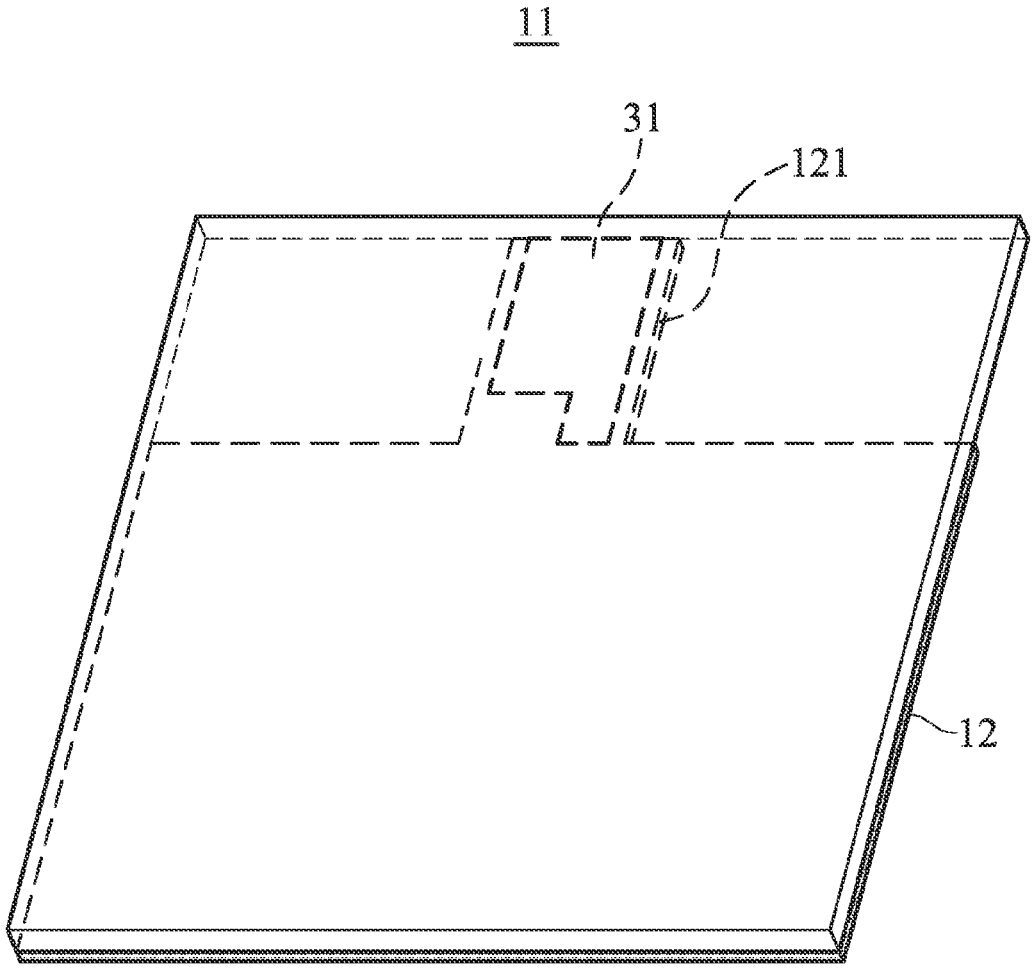
FIG. 1C is a pictorial drawing illustrating an system circuit board according to an embodiment of the invention.

FIG. 1C is a pictorial drawing illustrating the system circuit board 11 according to an embodiment of the invention. As shown in FIG. 1C, an area 31 on the additional ground 121 is the projection plane of the antenna ground plane 134. The additional ground 121 may overlap with the antenna ground plane 134 partially or completely.

Figure 1D:
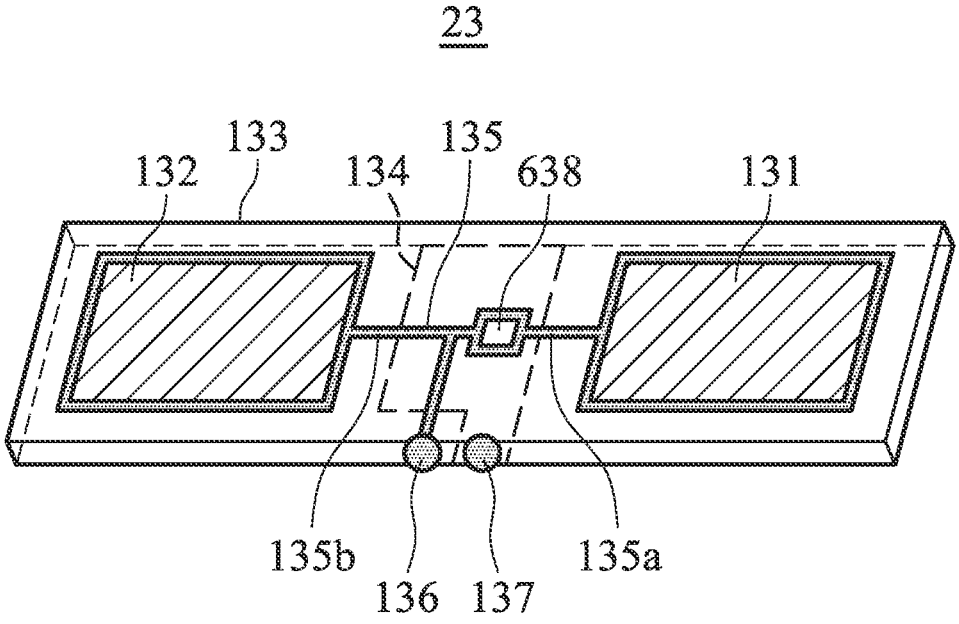
FIG. 1D is a pictorial drawing illustrating an antenna according to another embodiment of the invention.

FIG. 1D is a pictorial drawing illustrating an antenna 23 according to another embodiment of the invention. The antenna 13 of the mobile communication device 100 may be replaced with the antenna 23. As shown in FIG. 1D, the transmission line 135 may comprise a circuit component 638. One of the first and second branches 135*a*, 135*b* of the transmission line 135 may comprise the circuit component 638. In some embodiment, the circuit component 638 may be a resistor, an inductor, or a capacitor for impedance matching. According to a preferred embodiment of the invention, the circuit component 638 is a chip inductor.

Figure 1E:
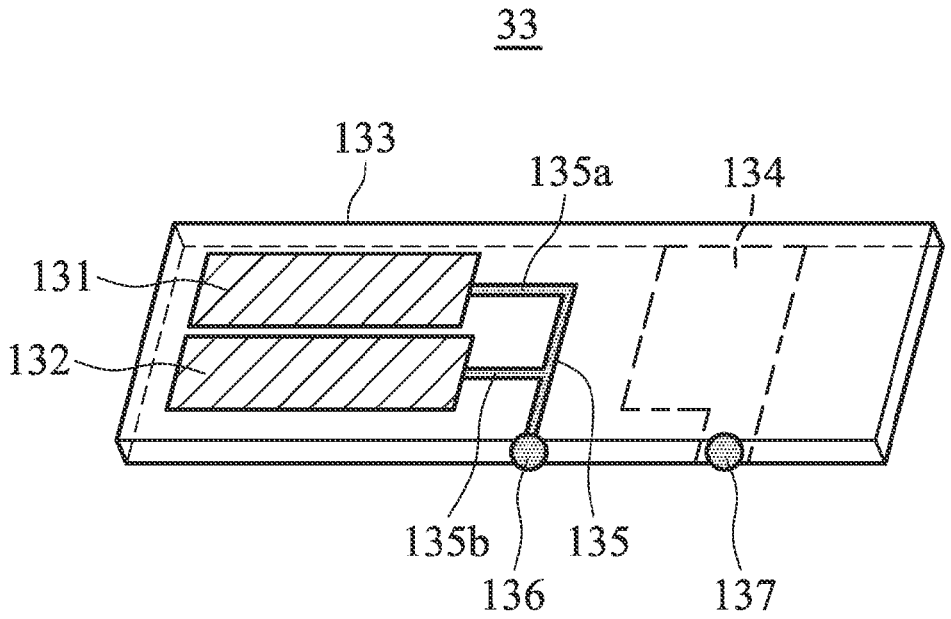
FIG. 1E is a pictorial drawing illustrating an antenna according to an embodiment of the invention.
Figure 1F:
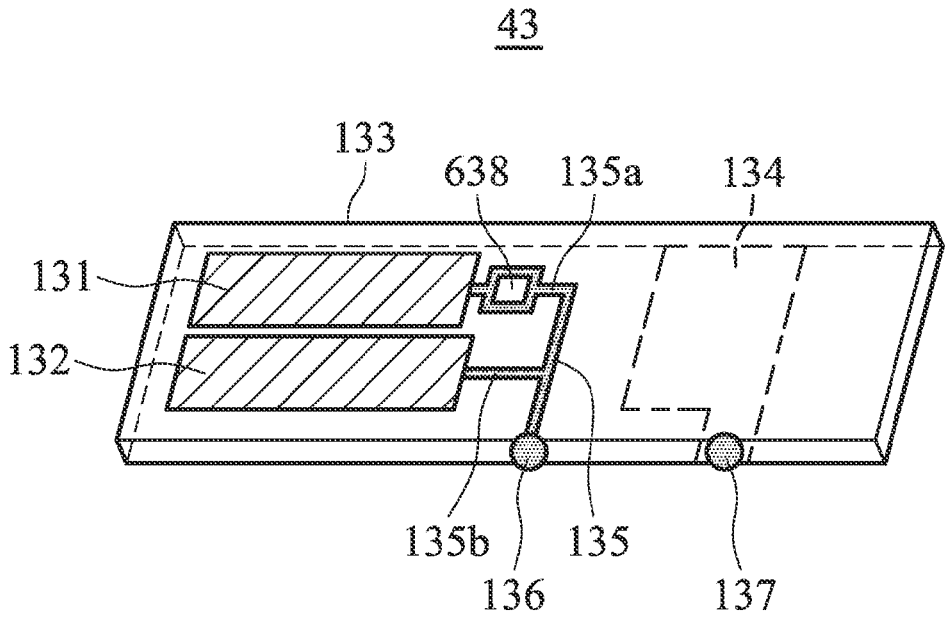
FIG. 1F is a pictorial drawing illustrating an antenna according to another embodiment of the invention

FIG. 1E is a pictorial drawing illustrating an antenna 33 according to an embodiment of the invention. The antenna ground plane 134 may not be disposed between the first and second radiation elements 131, 132. As shown in FIG. 1E, the antenna ground plane 134 is disposed on one side of the antenna substrate 133, and the first and second radiation elements 131, 132 are both disposed on the other side of the antenna substrate 133. The location of the antenna ground plane 134 has no significant impact on performance of the mobile communication device 100. Similarly, FIG. 1F is a pictorial drawing illustrating an antenna 43 according to another embodiment of the invention. As shown in FIG. 1F, the antenna ground plane 134 may not be disposed between the first and second radiation elements 131, 132, and one of the first and second branches 135*a*, 135*b* of the transmission line 135 may comprise the circuit component 638. The antenna 13 of the mobile communication device 100 may be replaced with the antennas 23, 33 or 43, and if so, the mobile communication device 100 would still work normally.

Figure 2A:
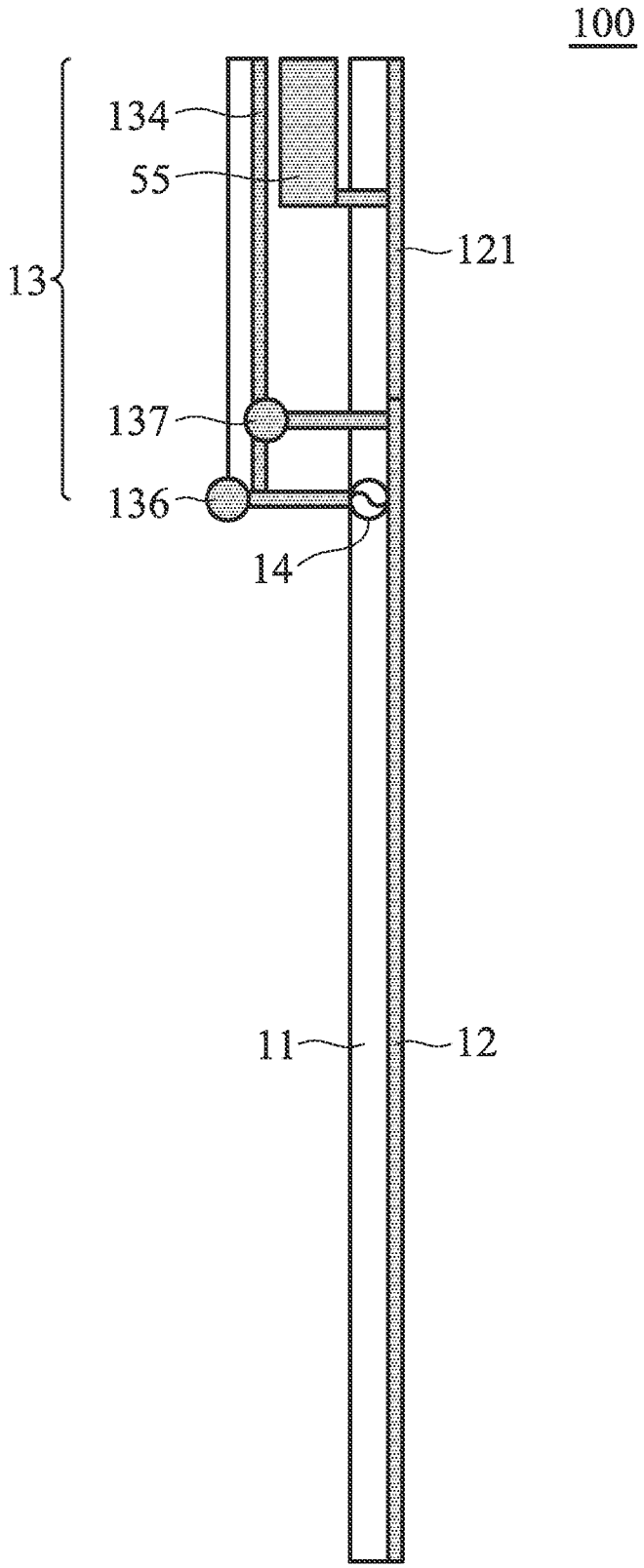
FIG. 2A is a side-view drawing illustrating a mobile communication device according to an embodiment of the invention.
Figure 2B:
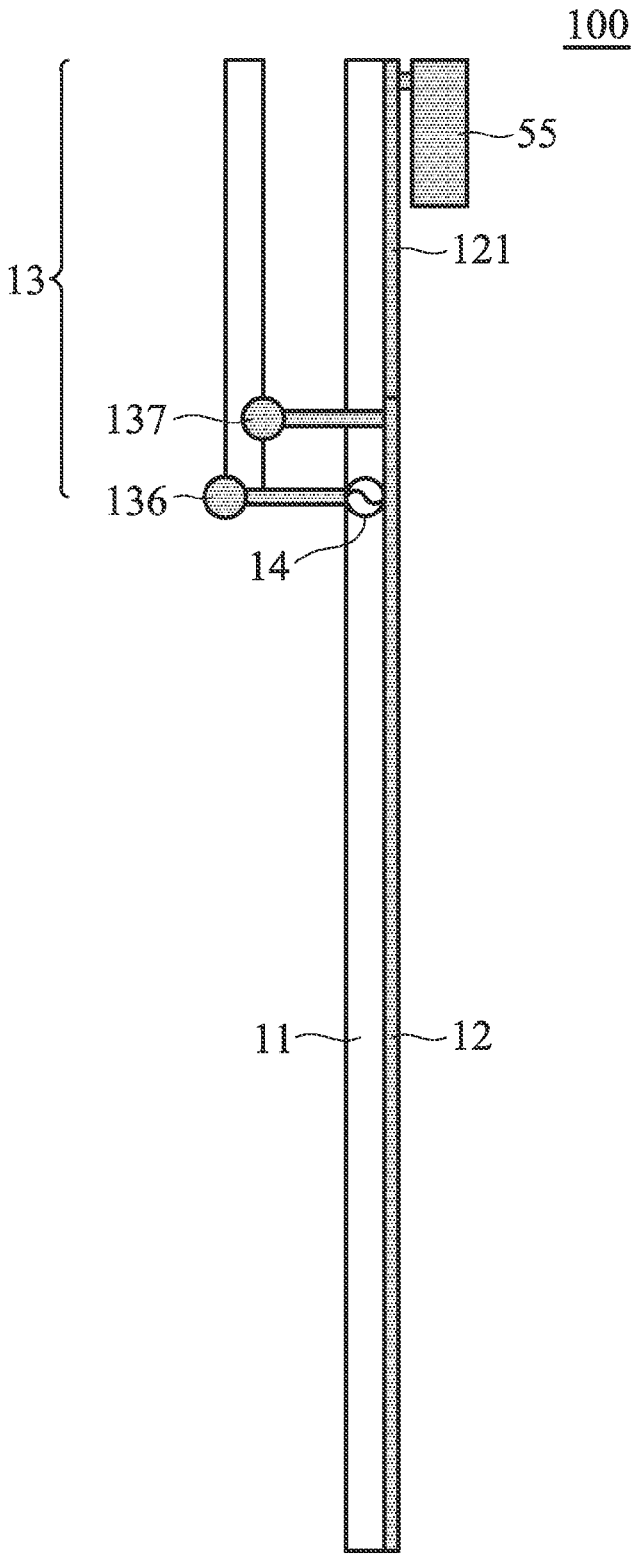
FIG. 2B is a side-view drawing illustrating a mobile communication device according to another embodiment of the invention.

FIG. 2A is a side-view drawing illustrating the mobile communication device 100 according to an embodiment of the invention. As shown in FIG. 2A, A data transmission component 55, such as a USB connector, may be disposed between the additional ground 121 and the antenna ground plane 134 in order to reduce interference. The data transmission component 55 provides a data transmission interface between the mobile communication device 100 and an external device. FIG. 2B is a side-view drawing illustrating the mobile communication device 100 according to another embodiment of the invention. As shown in FIG. 2B, the data transmission component 55 may be disposed below the system ground plane 12 for reducing interference.

Figure 3:
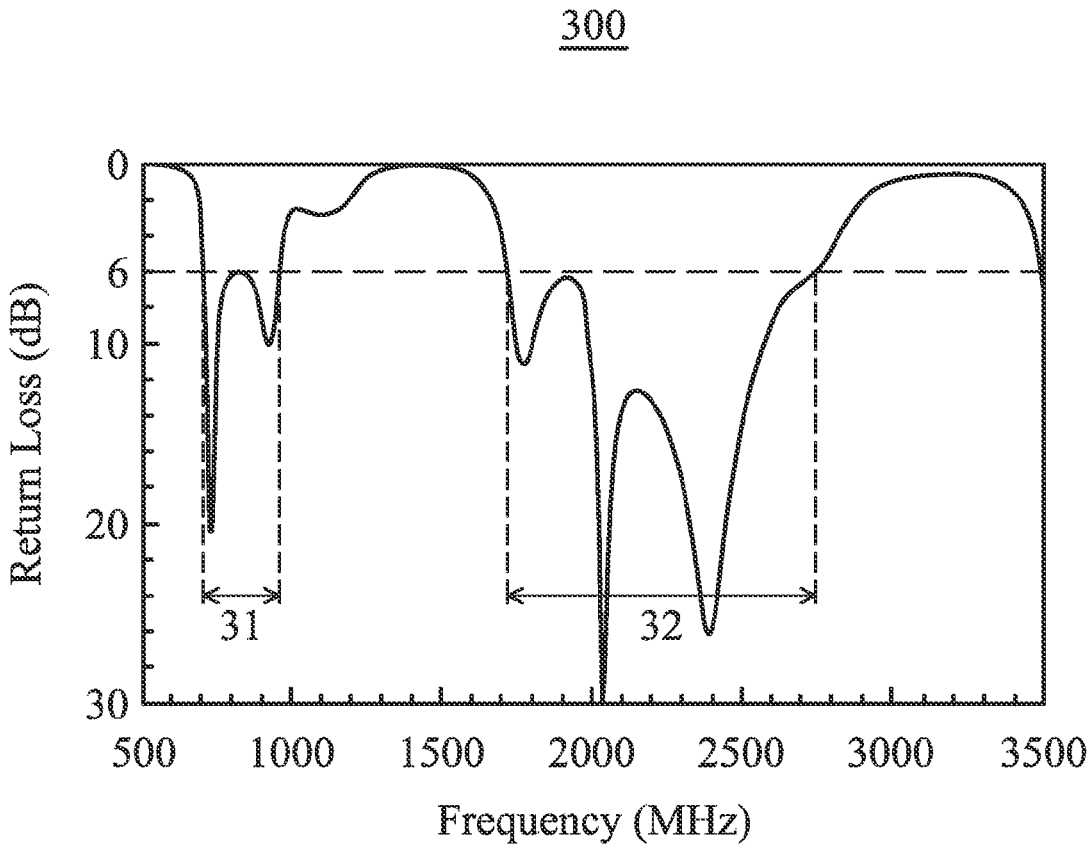
FIG. 3 is a diagram illustrating return loss of an antenna according to an embodiment of the invention.

FIG. 3 is a diagram 300 illustrating return loss of the antenna 13 according to an embodiment of the invention. FIG. 3 is utilized for illustrating return loss (unit: dB) over frequency (unit: MHz). As shown in FIG. 3, the antenna 13 covers the first and second frequency bands 31, 32 according to the criterion set as 6 dB. The first frequency band 31 is from about 704 MHz to 960 MHz, and the second frequency band 32 is from about 1710 MHz to 2690 MHz. In another embodiment, the first frequency band 31 is from about 824 MHz to 960 MHz, and the second frequency band 32 is from about 1710 MHz to 2170 MHz. It is noted that the antenna 23, 33 or 43 may also cover the same frequency bands as those of the antenna 13. Therefore, the antennas 13, 23, 33 or 43 of the mobile communication device 100 can be configured to cover the LTE700/GSM850/900 and GSM1800/1900/UMTS/LTE2300/2500 bands (LTE/WWAN 8 bands).

Figure 4A:
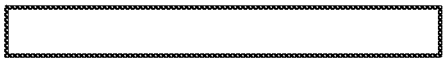
FIG. 4A is a drawing illustrating a monopole antenna according to an embodiment of the invention.
Figure 4B:
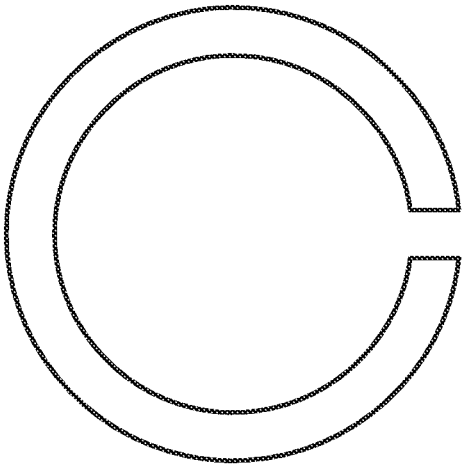
FIG. 4B is a drawing illustrating a loop antenna according to another embodiment of the invention.

FIG. 4A is a drawing illustrating a monopole antenna 401 according to an embodiment of the invention. FIG. 4B is a drawing illustrating a loop antenna 402 according to another embodiment of the invention. It is noted that the monopole antenna 401 may bend, and the loop antenna 402 may be of other shapes, such as a rectangular shape or a triangular shape. Each of the first and second radiation elements 131, 132 may be the monopole antenna 401 or the loop antenna 402.

In some embodiments of the invention, the sizes of the elements in the mobile communication device 100 may be as follows: the system circuit board 11 is approximately 112 mm by 60 mm in area; the system ground plane 12 is approximately 100 mm by 60 mm in area and substantially a rectangular shape; the additional ground 121 is approximately 12 mm by 10 mm in area; the antenna ground plane 134 is approximately 12 mm by 10 mm in area and substantially a rectangular shape; and the metal lines 15, 16 are both approximately 5 mm in length and 1 mm in width. It is noted that the sizes of the elements in the above embodiment are not limited. A person of ordinary skill can adjust the sizes of the elements according to the frequency band and the dielectric coefficient of designs.

Figure 5A:
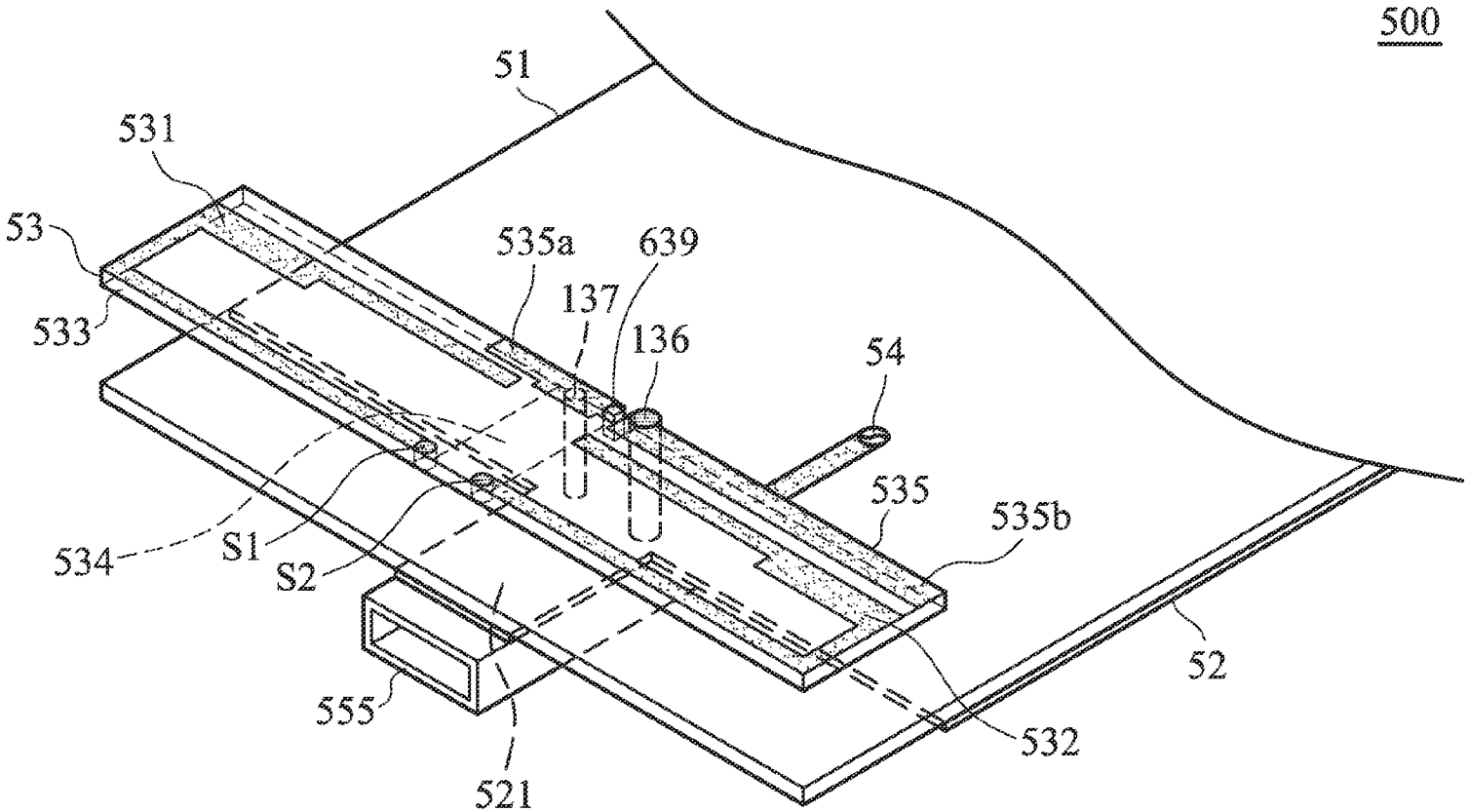
FIG. 5A is a pictorial drawing illustrating an antenna device according to an embodiment of the invention.

FIG. 5A is a pictorial drawing illustrating an antenna device 500 according to an embodiment of the invention. The design of the antenna device 500 is consistent with the basic structure of the mobile communication device 100, as shown in FIG. 1A. The antenna device 500 comprises a system circuit board 51 and an antenna component 53. The system circuit board 51 comprises a system ground plane 52, which may comprise an additional ground 521 on the edge of the system ground plane 52. It is noted that the antenna device 500 may merely include the system ground plane 52, without the system circuit board 51, and the antenna component 53.

Figure 5B:
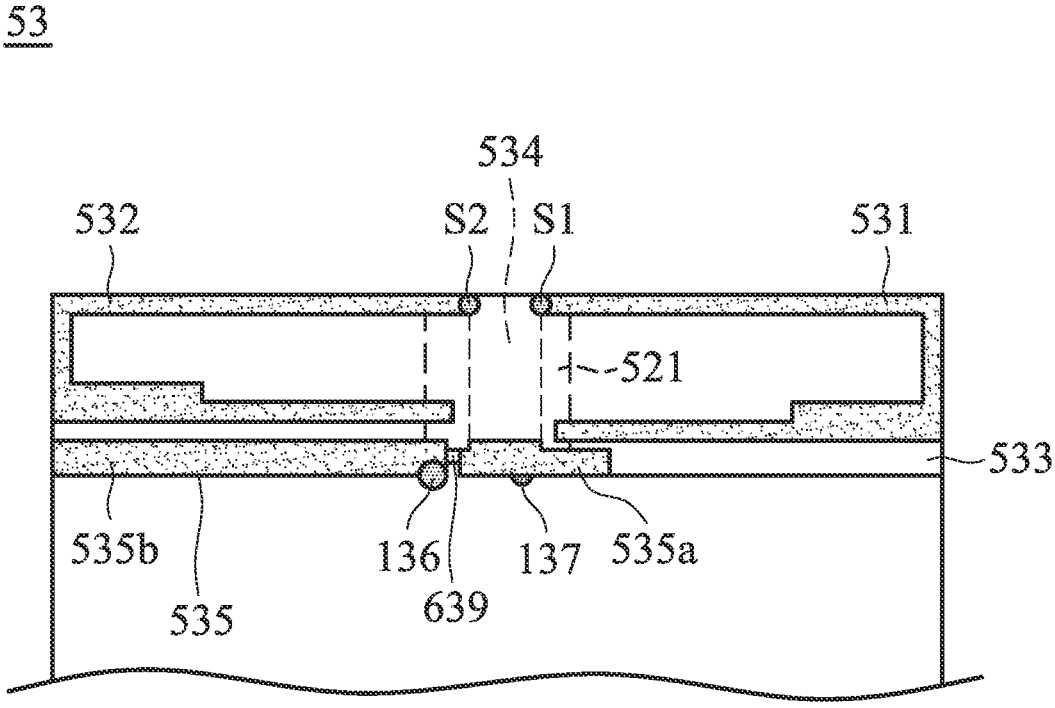
FIG. 5B is a plan-view drawing illustrating an antenna device according to an embodiment of the invention.

FIG. 5B is a plan-view drawing illustrating the antenna device 500 according to an embodiment of the invention. As shown in FIG. 5B, the antenna component 53 comprises: a first radiation element 531, a second radiation element 532, an antenna substrate 533, an antenna ground plane 534, and a transmission line 535. The antenna substrate 533 is substantially parallel to the system ground plane 52. The first and second radiation elements 531, 532 are disposed on the antenna substrate 533 and electrically coupled to the system ground plane 52 via shorting vias S1, S2, respectively. Being substantially a U-shape, the first radiation element 531 is electrically coupled to the system ground plane 52 through the antenna ground plane 534, wherein the shorting via S1 is electrically connected between the first radiation element 531 and the antenna ground plane 534. Similarly, being substantially a U-shape, the second radiation element 532 is electrically coupled to the system ground plane 52 through the antenna ground plane 534, wherein the shorting via S2 is electrically connected between the second radiation element 532 and the antenna ground plane 534. The antenna ground plane 534 is disposed on the antenna substrate 533 and electrically connected to the system ground plane 52 via a shorting point 137, which may be substantially disposed between the first and second radiation elements 531, 532. The additional ground 521 may overlap with the antenna ground plane 534 partially or completely. The antenna ground plane 534 may substantially separate the first radiation element 531 from the second radiation element 532. It is noted that the antenna ground plane 534 may not be disposed between the first and second radiation elements 531, 532, as shown in FIG. 1E or FIG. 1F. In another embodiment, the antenna ground plane 534 may be removed from the antenna component 53, and if so, the antenna device 500 would still work normally. Without the antenna ground plane 534, the first and second radiation elements 531, 532 may be directly and electrically connected to the system ground plane 52. The transmission line 535 is disposed on the antenna substrate 533 and comprises first and second branches 535*a*, 535*b*. The first branch 535*a* is close to the first radiation element 531 for mutual coupling and comprises a chip inductor 639, which has an inductance equal to about 15 nH. Similarly, the second branch 535*b* is close to the second radiation element 532 for mutual coupling. The transmission line 535 may have a feed point 136 for receiving signals, wherein the first and second branches 535*a*, 535*b* are both electrically connected to the feed point 136. In some embodiments, the transmission line 535 may be a microstrip line. The system ground plane 52, the first and second radiation elements 531, 532, the antenna ground plane 534 and the transmission line 535 may be made of metal, such as copper or silver.

Referring to FIG. 5A, the feed point 136 is electrically connected to a signal source 54 on the system circuit board 51 via a metal line. Similarly, the shorting point 137 is electrically connected to the system ground plane 52 via another metal line. The Universal Serial Bus (USB) connector 555 may be disposed below the system ground plane 52, as shown in FIGS. 2B, 5A. In another embodiment, the USB connector 555 may be disposed between the additional ground 521 and the antenna ground plane 534 in order to reduce interference, as shown in FIG. 2A.

Figure 5C:
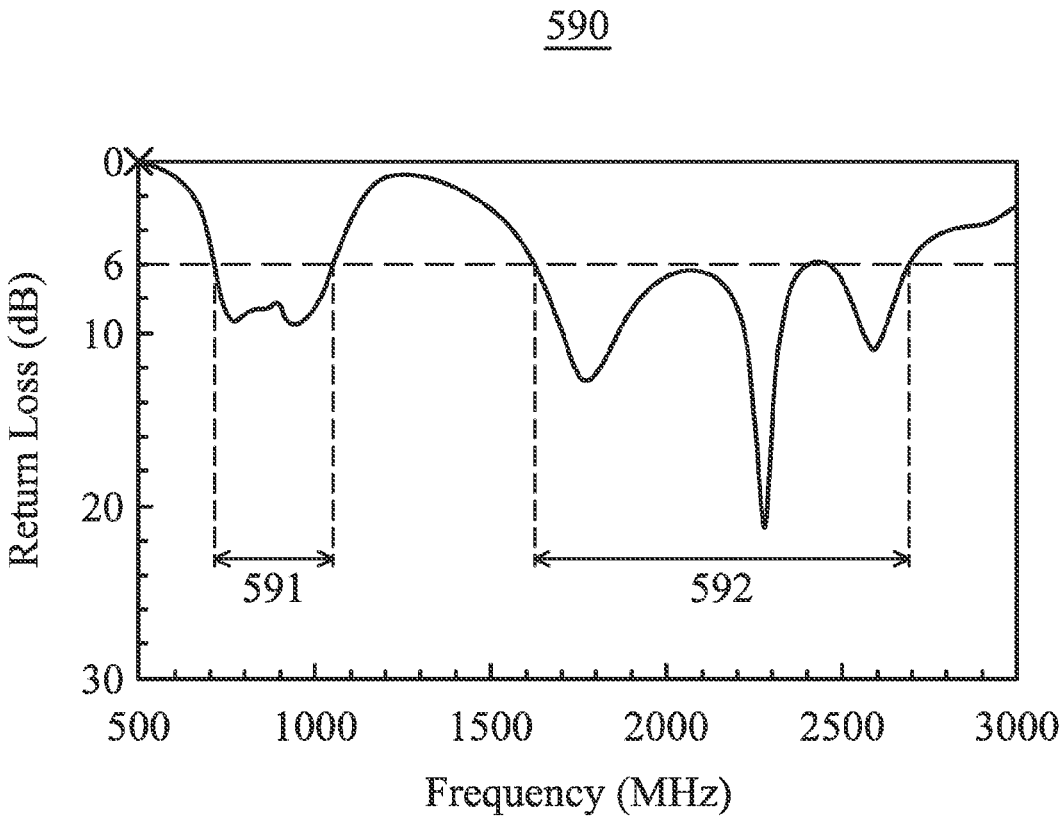
FIG. 5C is a diagram illustrating return loss of an antenna device according to an embodiment of the invention.

FIG. 5C is a diagram 590 illustrating return loss of the antenna device 500 according to an embodiment of the invention. FIG. 5C is utilized for illustrating return loss (unit: dB) over frequency (unit: MHz). As shown in FIG. 5C, the antenna device 500 covers the first and second frequency bands 591, 592 according to the criterion set as 6 dB. The first frequency band 591 is from about 704 MHz to 960 MHz, and the second frequency band 592 is from about 1710 MHz to 2690 MHz. In another embodiment, the first frequency band 591 is from about 824 MHz to 960 MHz, and the second frequency band 592 is from about 1710 MHz to 2170 MHz.

The first branch 535*a* and the first radiation element 531 are excited, and the second branch 535*b* and the second radiation element 532 are also excited, to form the first frequency band 591 together. The second branch 535*b* and the second radiation element 532 are excited to form the second frequency band 592.

In some embodiments of the invention, the sizes of the elements in the antenna device 500 are as follows. The system circuit board 51 has a dielectric constant equal to 4.3 (FR4 substrate) and of 0.8 mm thickness. The antenna substrate 533 has a dielectric constant equal to 4.3 (FR4 substrate) and of 1 mm thickness. The antenna ground plane 534 is approximately 60 $mm^2$, e.g., 5 mm by 12 mm, in area. The additional ground 521 is approximately 108 $mm^2$, e.g., 9 mm by 12 mm, in area. The first branch 535*a* is approximately 10 mm in length, and the second branch 535*b* is approximately 26.5 mm in length. The total length of the first radiation element 531 is approximately 60.5 mm, and the total length of the second radiation element 532 is approximately 62 mm. It is noted that the sizes of the elements in the above embodiment are not limited. A person of ordinary skill can adjust the sizes of the elements according to the frequency band and the dielectric constant.

Figure 6A:
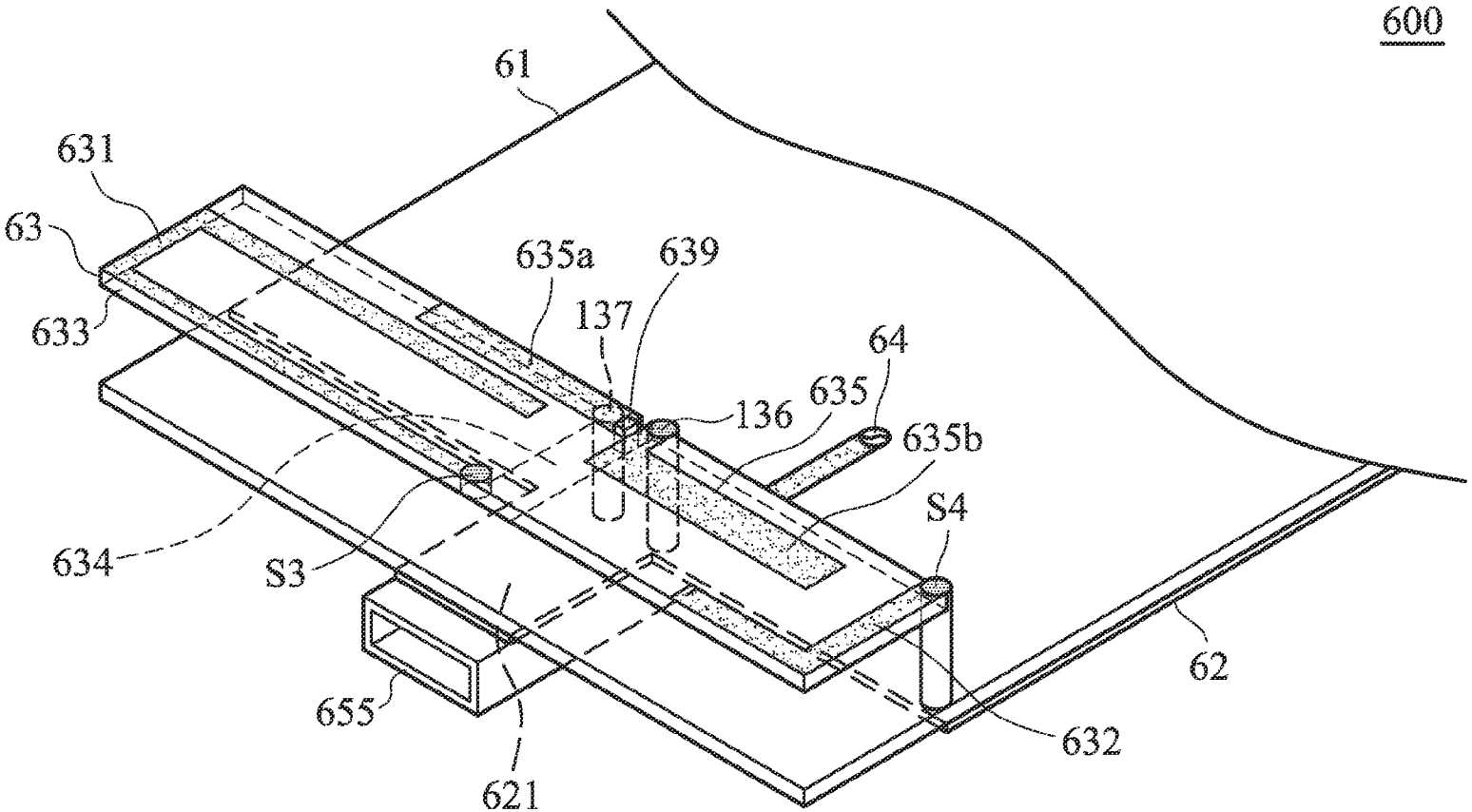
FIG. 6A is a pictorial drawing illustrating an antenna device according to another embodiment of the invention.

FIG. 6A is a pictorial drawing illustrating an antenna device 600 according to another embodiment of the invention. The design of the antenna device 600 is consistent with the basic structure of the mobile communication device 100, as shown in FIG. 1A. The antenna device 600 comprises a system circuit board 61 and an antenna component 63. The system circuit board 61 comprises a system ground plane 62, which may comprise an additional ground 621 on the edge of the system ground plane 62. It is noted that the antenna device 600 may merely include the system ground plane 62, without the system circuit board 61, and the antenna component 63.

Figure 6B:
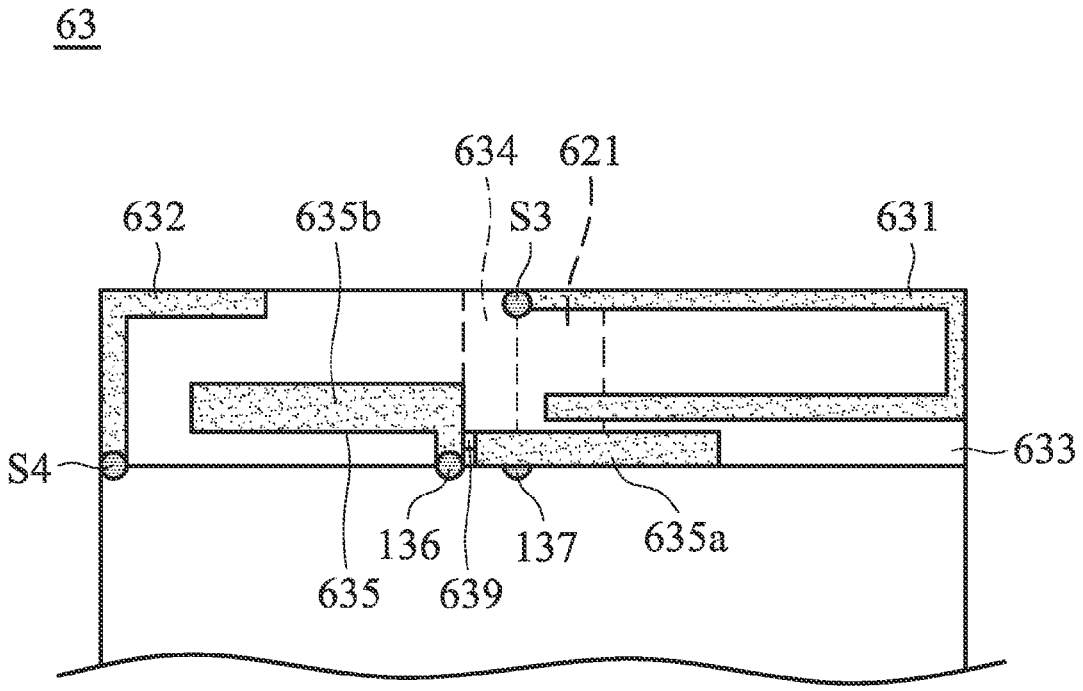
FIG. 6B is a plan-view drawing illustrating an antenna device according to an embodiment of the invention.

FIG. 6B is a plan-view drawing illustrating the antenna device 600 according to an embodiment of the invention. As shown in FIG. 6B, the antenna component 63 comprises: a first radiation element 631, a second radiation element 632, an antenna substrate 633, an antenna ground plane 634, and a transmission line 635. The antenna substrate 633 is substantially parallel to the system ground plane 62. The first and second radiation elements 631, 632 are disposed on the antenna substrate 633 and electrically coupled to the system ground plane 62 via shorting vias S3, S4, respectively. Being substantially a U-shape, the first radiation element 631 is electrically coupled to the system ground plane 62 through the antenna ground plane 634, wherein the shorting via S3 is electrically connected between the first radiation element 631 and the antenna ground plane 634. Being substantially an L-shape, the second radiation element 632 is electrically connected to the system ground plane 62, wherein the shorting via S4 is electrically connected to the system ground plane 62 via a metal line. The antenna ground plane 634 is disposed on the antenna substrate 633 and electrically connected to the system ground plane 62 via a shorting point 137, which may be substantially disposed between the first and second radiation elements 631, 632. The additional ground 621 may overlap with the antenna ground plane 634 partially or completely. The antenna ground plane 634 may substantially separate the first radiation element 631 from the second radiation element 632. It is noted that the antenna ground plane 634 may not be disposed between the first and second radiation elements 631, 632, as shown in FIG. 1E or FIG. 1F. In another embodiment, the antenna ground plane 634 may be removed from the antenna component 63, and if so, the antenna device 600 would still work normally. Without the antenna ground plane 634, the first radiation element 531 may be directly and electrically connected to the system ground plane 62. The transmission line 635 is disposed on the antenna substrate 633 and comprises first and second branches 635*a*, 635*b*. The first branch 635*a* is close to the first radiation element 631 for mutual coupling and comprises a chip inductor 639, which has an inductance equal to 15 nH. On the other hand, the second branch 635*b* is not required to be close to the second radiation element 632. The transmission line 635 may have a feed point 136 for receiving signals, wherein the first and second branches 635*a*, 635*b* are both electrically connected to the feed point 136. In some embodiments, the transmission line 635 may be a microstrip line. The system ground plane 62, the first and second radiation elements 631, 632, the antenna ground plane 634 and the transmission line 635 may be made of metal, such as copper or silver.

Referring to FIG. 6A, the feed point 136 is electrically connected to a signal source 64 on the system circuit board 61 via a metal line. Similarly, the shorting point 137 is electrically connected to the system ground plane 62 via another metal line. The USB connector 655 may be disposed below the system ground plane 62, as shown in FIGS. 2B, 6A. In another embodiment, the USB connector 655 may be disposed between the additional ground 621 and the antenna ground plane 634 in order to reduce interference, as shown in FIG. 2A.

Figure 6C:
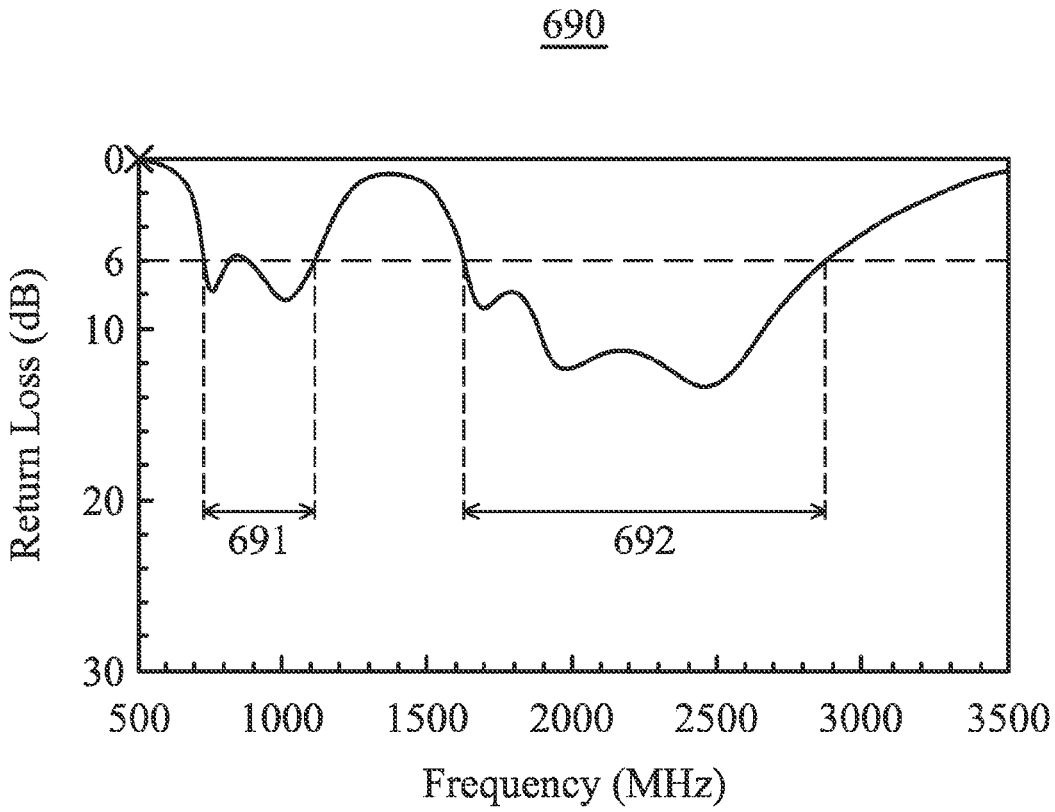
FIG. 6C is a diagram illustrating return loss of an antenna device according to an embodiment of the invention.

FIG. 6C is a diagram 690 illustrating return loss of the antenna device 600 according to an embodiment of the invention. FIG. 6C is utilized for illustrating return loss (unit: dB) over frequency (unit: MHz). As shown in FIG. 6C, the antenna device 600 covers the first and second frequency bands 691, 692 according to the criterion set as 6 dB. The first frequency band 691 is from about 704 MHz to 960 MHz, and the second frequency band 692 is from about 1710 MHz to 2690 MHz. In another embodiment, the first frequency band 691 is from about 824 MHz to 960 MHz, and the second frequency band 692 is from about 1710 MHz to 2170 MHz.

The first branch 635*a* and the first radiation element 631 are excited to form the first frequency band 691. The second branch 635*b* and the second radiation element 632 are excited to form the second frequency band 692.

In some embodiments of the invention, the sizes of the elements in the antenna device 600 are as follows. The system circuit board 61 has a dielectric constant equal to 4.3 (FR4 substrate) and of 0.8 mm thickness. The antenna substrate 633 has a dielectric constant equal to 4.3 (FR4 substrate) and of 1 mm thickness. The antenna ground plane 634 is approximately 60 $mm^2$, e.g., 5 mm by 12 mm, in area. The additional ground 621 is approximately 120 $mm^2$, e.g., 10 mm by 12 mm, in area. The first branch 635*a* is approximately 17 mm in length, and the second branch 635*b* is approximately 18 mm in length. The total length of the first radiation element 631 is approximately 65 mm, and the total length of the second radiation element 632 is approximately 22 mm. It is noted that the sizes of the elements in the above embodiment are not limited. A person of ordinary skill can adjust the sizes of the elements according to the frequency band and the dielectric constant.

The invention provides mobile communication devices and antenna devices that can cover 8 frequency bands of LTE/WWAN of 4G communication systems. The mobile communication devices and antenna devices are further configured to accommodate a data transmission component, such as a USB connector. Because of the shield of the system ground plane (including the additional ground) or the antenna ground plane, the data transmission component has little impact on the mobile communication devices or the antenna devices, resulting in little signal interference. Therefore, the mobile communication devices and the antenna devices of the invention can have well HAC and SAR values.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile communication device, comprising:

a system circuit board, comprising a system ground plane; and an antenna, comprising:

an antenna substrate, substantially parallel to the system ground plane;

a first radiation element, disposed on the antenna substrate;

a second radiation element, disposed on the antenna substrate;

an antenna ground plane, disposed on the antenna substrate, and coupled to the system ground plane; and a transmission line, disposed on the antenna substrate, coupled to the first and second radiation elements, and having a feed point;

wherein the system ground plane comprises an additional ground which overlaps with the antenna ground plane partially or completely;

wherein the antenna substrate is not a layer of the system circuit board.

2. The mobile communication device as claimed in claim 1, wherein a data transmission component is disposed between the additional ground and the antenna ground plane, and the data transmission component provides a data transmission interface between the mobile communication device and an external device.

3. The mobile communication device as claimed in claim 2, wherein the data transmission component is a Universal Serial Bus (USB) connector.

4. The mobile communication device as claimed in claim 1, wherein the antenna ground plane substantially separates the first radiation element from the second radiation element.

5. The mobile communication device as claimed in claim 1, wherein the antenna covers the frequency band from 824 MHz to 960 MHz substantially and from 1710 MHz to 2170 MHz substantially.

6. The mobile communication device as claimed in claim 1, wherein the antenna covers the frequency band from 704 MHz to 960 MHz substantially and from 1710 MHz to 2690 MHz substantially.

7. The mobile communication device as claimed in claim 1, wherein the transmission line is a microstrip line.

8. The mobile communication device as claimed in claim 1, wherein the first radiation element is a loop antenna or a monopole antenna.

9. The mobile communication device as claimed in claim 1, wherein the second radiation element is a loop antenna or a monopole antenna.

10. The mobile communication device as claimed in claim 1, wherein the feed point is coupled to a signal source on the system circuit board.

11. The mobile communication device as claimed in claim 1, wherein the transmission line comprises a circuit component.

12. The mobile communication device as claimed in claim 11, wherein the circuit component is a chip inductor.

13. The mobile communication device as claimed in claim 1, wherein a data transmission component is disposed below the system ground plane.

14. An antenna device, comprising:

a system ground plane;

an antenna substrate, substantially parallel to the system ground plane;

a first radiation element, disposed on the antenna substrate, and coupled to the system ground plane;

a second radiation element, disposed on the antenna substrate, and coupled to the system ground plane; and a transmission line, disposed on the antenna substrate, and comprising:

a first branch, close to the first radiation element, comprising a chip inductor, and coupled to a feed point; and a second branch, coupled to the feed point.

15. The antenna device as claimed in claim 14, further comprising:

an antenna ground plane, disposed on the antenna substrate, and coupled to the system ground plane.

16. The antenna device as claimed in claim 15, wherein the antenna ground plane substantially separates the first radiation element from the second radiation element.

17. The antenna device as claimed in claim 15, wherein the system ground plane comprises an additional ground which overlaps with the antenna ground plane partially or completely, and a USB connector is disposed between the additional ground and the antenna ground plane.

18. The antenna device as claimed in claim 14, wherein each of the first and second radiation elements is U-shaped, and the second branch is close to the second radiation element.

19. The antenna device as claimed in claim 18, wherein:

the first and second radiation elements and the first and second branches are excited to form a first frequency band;

the second radiation element and the second branch are excited to form a second frequency band; and the second frequency band is higher than the first frequency band.

20. The antenna device as claimed in claim 19, wherein the first frequency band is from 824 MHz to 960 MHz substantially, and the second frequency band is from 1710 MHz to 2170 MHz substantially.

21. The antenna device as claimed in claim 19, wherein the first frequency band is from 704 MHz to 960 MHz substantially, and the second frequency band is from 1710 MHz to 2690 MHz substantially.

22. The antenna device as claimed in claim 18, wherein each of the first and second radiation elements is coupled to the system ground plane through an antenna ground plane, and the antenna ground plane is disposed on the antenna substrate.

23. The antenna device as claimed in claim 14, wherein the first radiation element is U-shaped, and the second radiation branch is L-shaped.

24. The antenna device as claimed in claim 23, wherein:

the first radiation element and the first branch are excited to form a first frequency band;

the second radiation element and the second branch are excited to form a second frequency band; and the second frequency band is higher than the first frequency band.

25. The antenna device as claimed in claim 24, wherein the first frequency band is from 824 MHz to 960 MHz substantially, and the second frequency band is from 1710 MHz to 2170 MHz substantially.

26. The antenna device as claimed in claim 24, wherein the first frequency band is from 704 MHz to 960 MHz substantially, and the second frequency band is from 1710 MHz to 2690 MHz substantially.

27. The antenna device as claimed in claim 23, wherein the first radiation element is coupled to the system ground plane through an antenna ground plane, and the antenna ground plane is disposed on the antenna substrate.

* * * * *